US007722319B2

(12) United States Patent
Staempfli et al.

(10) Patent No.: US 7,722,319 B2
(45) Date of Patent: May 25, 2010

(54) LOCKING AND FIXING DEVICE FOR A HEAT SHIELD ELEMENT FOR A ROTOR UNIT OF A TURBOMACHINE

(75) Inventors: Matthias Staempfli, Doettingen (CH); Ingolf Schulz, Baden (CH); Ronald Wifling, Küssaberg (DE); Michael Seemann, Laufenburg (DE)

(73) Assignee: Alstom Technology Ltd, Baden (CH)

( * ) Notice: Subject to any disclaimer, the term of this patent is extended or adjusted under 35 U.S.C. 154(b) by 144 days.

(21) Appl. No.: 12/071,381

(22) Filed: Feb. 20, 2008

(65) Prior Publication Data

US 2008/0181778 A1 Jul. 31, 2008

Related U.S. Application Data

(63) Continuation of application No. PCT/EP2006/065547, filed on Aug. 22, 2006.

(30) Foreign Application Priority Data

Aug. 23, 2005 (CH) ..... 1373/05

(51) Int. Cl.
*F01D 5/08* (2006.01)
*F01D 5/30* (2006.01)

(52) U.S. Cl. ..... 415/182.1; 415/186; 415/198.1; 415/199.1; 415/199.4; 416/198 A; 416/220 R; 29/888.025

(58) Field of Classification Search ..... 415/182.1, 415/196, 198.1, 199.1, 199.4; 416/198 A, 416/220 R; 29/888.025
See application file for complete search history.

(56) References Cited

U.S. PATENT DOCUMENTS 3,056,578 A 10/1962 Auger (Continued)

FOREIGN PATENT DOCUMENTS

EP 1 079 070 A2 2/2001

(Continued)

OTHER PUBLICATIONS

PCT/ISA/210.

(Continued)

*Primary Examiner*—Igor Kershteyn
(74) *Attorney, Agent, or Firm*—Buchanan Ingersoll & Rooney PC

(57) ABSTRACT

A locking and fixing device for a heat shield element, which heat shield element can be arranged along a heat shield row axially directly next to at least one blade provided in a blade row and has, axially facing the blade, at least two projections of rib-like design which are spaced apart in the circular circumferential direction, are raised above a side wall section facing the blade and define a clear intermediate space which extends in the circular circumferential direction and into which a locking lug provided on the blade can be fitted. Further disclosed is at least one rib-like projection, on its side facing away from the clear intermediate space, providing an extension which extends in the circular circumferential direction, is connected to the projection and the side wall section and rises above the side wall section at most up to the rib height of the projection.

19 Claims, 4 Drawing Sheets

U.S. PATENT DOCUMENTS

| | | | | | |
|---|---|---|---|---|---|
| 4,277,225 | A | * | 7/1981 | Dubois et al. | 416/198 A |
| 4,645,424 | A | * | 2/1987 | Peters | 416/198 A |
| 5,318,405 | A | * | 6/1994 | Meade et al. | 416/220 R |
| 5,338,154 | A | * | 8/1994 | Meade et al. | 415/173.7 |
| 5,833,244 | A | | 11/1998 | Salt et al. | |
| 6,464,453 | B2 | * | 10/2002 | Toborg et al. | 415/115 |
| 6,655,920 | B2 | * | 12/2003 | Beutin et al. | 416/198 A |

FOREIGN PATENT DOCUMENTS

| | | |
|---|---|---|
| EP | 1 211 386 A2 | 6/2002 |
| EP | 1 371 814 A1 | 12/2003 |

OTHER PUBLICATIONS

PCT/ISA/237.

* cited by examiner

LOCKING AND FIXING DEVICE FOR A HEAT SHIELD ELEMENT FOR A ROTOR UNIT OF A TURBOMACHINE

RELATED APPLICATIONS

This application claims priority under 35 U.S.C. §119 to Swiss Application No. 01373/05 filed in the Swiss Patent Office on 23 Aug. 2005, and as a continuation application under 35 U.S.C. §120 to PCT/EP2006/065547 filed as an International Application on 22 Aug. 2006 designating the U.S., the entire contents of which are hereby incorporated by reference in their entireties.

TECHNICAL FIELD

A locking and fixing device for a heat shield element is disclosed which can be connected to a rotor unit of an axial-flow turbomachine and which can be arranged along a heat shield row axially directly next to at least one blade provided in a blade row and has, axially facing the blade, at least two projections of rib-like design which are spaced apart in the circular circumferential direction, are raised above a side wall section facing the blade and define a clear intermediate space which extends in the circular circumferential direction and into which a locking lug provided on the blade can be fitted. A method for producing the device is also disclosed.

BACKGROUND INFORMATION

Hot gases pass through axial-flow turbomachines, in particular gas turbine plants for generating electrical energy, for driving the rotor-side turbine blading, which hot gases issue from the combustion chamber and subject all the walls enclosing the hot-gas duct and also components projecting into the hot-gas duct, such as vanes and blades for example, to extreme thermal loading. Due to the system and the design, the blades fastened to the rotor unit are provided in a plurality of blade rows which are arranged axially one behind the other and are at a respective axial distance from one another, which forms an intermediate space between two axially adjacent blade rows, and vane airfoils fastened on the stator side project into said intermediate space.

In regions of the rotor unit in which the rotor unit is radially surrounded by blades, the shroud bands lying radially on the inside on the blades prevent the hot gases which flow through the hot-gas duct from coming into contact with the rotor unit. Located in the regions between the blade rows for the thermal protection of the rotor unit are "heat shield elements", which are arranged, as it were, like the blades in "heat shield rows". Radially on the inside, the heat shield elements have a root contour, with which the heat shield elements are connected to the rotor unit, and have as heat shield a type of radially outer shroud band, which, via corresponding sealing contours, engages as far as possible in a gastight manner with the respective shroud bands of the axially directly adjacent blades.

Such an arrangement known per se can be seen from FIG. 2, which shows a partial longitudinal section through a rotor unit 1, to which blades 2, 3 of two axially opposite blade rows 2', 3' are connected. Provided so as to lie axially in between in the circular circumferential direction of the rotor unit 1 are a multiplicity of heat shield elements 4, the respective shroud band 5 of which leads axially on both opposite sides into corresponding sealing contours provided in the shroud bands 6, 7 of the blades 2, 3.

In order to prevent the heat shield elements 4 arranged in the circular circumferential direction from starting to wander in an uncontrolled manner in the circumferential direction relative to the blades due to rotation, at least the blade 2 shown in FIG. 2 provides a projecting "rectangular fastening lug" 11 radially on the inside below its shroud band 6 in the axial direction of the heat shield element 4, and this fastening lug 11, if appropriately positioned both in the axial direction and in the circular circumferential direction relative to the heat shield element 4, can be fitted into a clear intermediate space 13 which is defined by two projections 9, 10 of rib-like design which rise above a side wall section 8, facing the blade 2, of the heat shield element 4. Shown in FIG. 3 is a highly schematic partial plan view which shows the shroud band 5 of the heat shield element 4 in the axial direction of view, and extending under said shroud band 5 is the side wall section 8 which axially faces the blade and on which the two projections 9, 10 of rib-like design spaced apart in the circular circumferential direction u are provided. In the illustration shown according to FIG. 3, the fastening lug 11, which is of rectangular design in cross section and is firmly connected to the blade 2, preferably in one piece, is fitted within the clear intermediate space 13 defined in the circumferential direction u by both projections 9, 10.

For the case where the joined state shown in FIG. 3 between the fastening lug 11 of the blade 2 and the projections 9, 10 of the heat shield element 4 has been accomplished, it is ensured that all the heat shield elements 4 provided within the heat shield row are arranged in a rotationally fixed manner relative to the blades along the blade row 2'.

However, if the respective blade and the heat shield element axially opposite the respective blade are incorrectly positioned relative to one another as viewed in the circumferential direction u in the course of incorrect fitting, the case occurs where the fastening lug 11 provided by the blade 2 is not positioned in the region of the clear intermediate space 13 between both projections 9, 10 of rib-like design, but rather is positioned in the adjoining regions in the circumferential direction u, in which, however, there is no protection at all against rotational misalignment between the heat shield elements and the respective blades.

The spatial direction marked by the arrow in FIG. 2 indicates the removal direction −x for the blades arranged in the blade row 2', the opposite direction, identified by +x, representing the fitting direction, in which the individual blades are pushed into the corresponding leading blade row along the rotor. A control wire K having a predetermined wire thickness serves in a manner known per se for the closure control once all the blades have been pushed axially into the blade row 2', so that the wire K can be pushed through a suitable intermediate gap between two heat shield elements arranged in an adjacent position in the circular circumferential direction. It has hitherto been decided whether the fitting operation has been effected correctly or incorrectly depending on the push-in depth. However, it has been found that, even in the event of misaligned fitting of the projecting fastening lug provided on the respective blades and projections provided by the heat shield elements, corresponding positive closure control can be effected by means of the control wire. It is necessary to completely rule out this possibility.

SUMMARY

A locking and fixing device for a heat shield element is disclosed which can be connected to a rotor unit of an axial-flow turbomachine, with which method incorrect fitting in the sense explained above can definitely be ruled out. The measures to be taken for this purpose are to be technically simple and are to be capable of being retrofitted where possible in already existing heat shield elements.

A method is disclosed with which the abovementioned device can be produced.

A locking and fixing device for a heat shield element is disclosed which can be connected to a rotor unit of an axial-flow turbomachine and which can be arranged along a heat shield row axially directly next to at least one blade provided in a blade row and has, axially facing the blade, at least two projections of rib-like design which are spaced apart in the circular circumferential direction, are raised above a side wall section facing the blade and define a clear intermediate space which extends in the circular circumferential direction and into which a locking lug provided on the blade can be fitted, wherein at least one rib-like projection, on its side facing away from the clear intermediate space, provides an extension which extends in the circular circumferential direction, is connected to the projection and the side wall section and rises above the side wall section at most up to the rib height of the projection.

A method for producing a locking and fixing device for a heat shield element is disclosed which can be connected to a rotor unit of an axial-flow turbomachine and which can be arranged along a heat shield row axially directly next to at least one blade provided in a blade row and has, axially facing the blade, at least two projections of rib-like design which are spaced apart in the circular circumferential direction, are raised above a side wall section facing the blade and define a clear intermediate space which extends in the circular circumferential direction and into which a locking lug provided on the blade can be fitted, characterized in that a build-up of material which extends in the circular circumferential direction and is connected to the projection and the side wall section is carried out on at least one rib-like projection on its side facing away from the clear intermediate space.

BRIEF DESCRIPTION OF THE DRAWINGS

The disclosure is described by way of example below with reference to exemplary embodiments and the drawing without restricting the general idea of the disclosure. In the drawing.

DETAILED DESCRIPTION

Figure 1A:
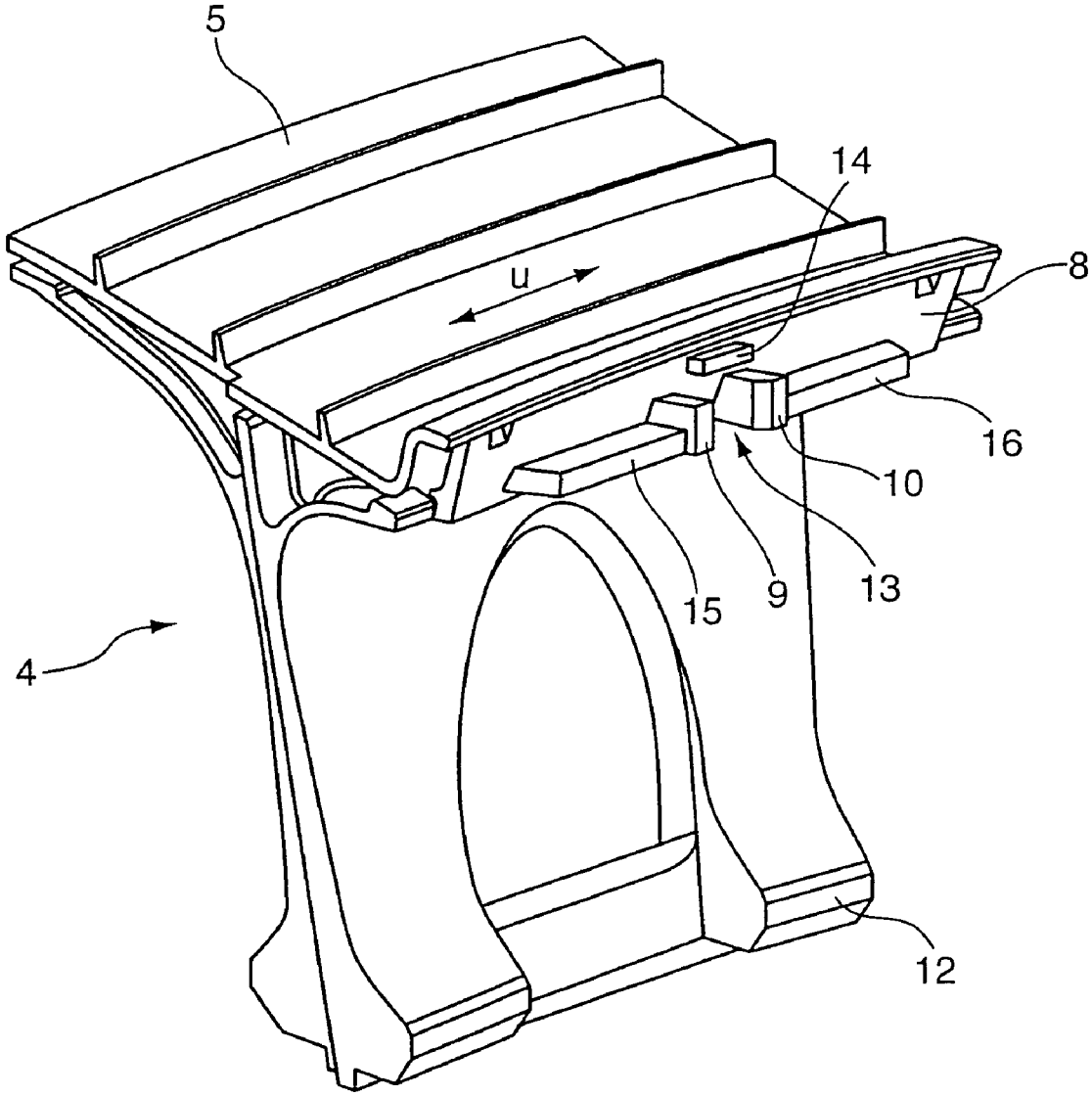
FIGS. 1*a* and *b* show a perspective illustration of a heat shield element having projections of rib-like design.

According to the disclosure, a device is configured in such a way that at least one rib-like projection, on its side facing away from the clear intermediate space, provides an extension which extends in the circular circumferential direction, is connected to the projection and the side wall is section and rises above the side wall section at most up to the rib height of the projection.

The extension according to the disclosure, which is to be provided at least on one of the two projections, preferably on both projections, in such a way as to correspondingly face away from the intermediate space in the circular circumferential direction on the individual projections, has two advantageous functions, namely: firstly, mechanical stabilization, acting in the circular circumferential direction, of the projection, so that the latter cannot be deformed possibly during fitting work but also during operation; secondly, the extension acts as a widening of the respective projection, this widening being directed in the circular circumferential direction, so that, during fitting work, the fastening lug provided on the blade side cannot miss the clear intermediate space defined by both projections. If the blade should be maladjusted relative to the heat shield element in the circular circumferential direction when being axially inserted into position on the rotor unit, the fastening lug of the blade abuts at the end face against the respective extension, which directly adjoins the projection provided on the heat shield element. In this case, it is not possible for the blade and the heat shield element to be brought fully together axially, as a result of which incorrect fitting can be ruled out.

Since the projections, preferably of rib-shaped design, provided on the heat shield element constitute designs which are already formed by the casting process for producing the heat shield element and are therefore connected in one piece to the heat shield element, subsequent modification of the heat shield element produced as a cast part is required in order to provide at least one extension, proposed according to the solution, on a projection of rib-like design. Suitable for this purpose in an especially advantageous manner is welding technology, with which it is possible in principle to form a material accumulation oriented in the circular circumferential direction directly adjacent to at least one projection of rib-like design. In an exemplary embodiment, the extension is designed in the form of a triangular surface element which is joined to the projection in a suitable manner by the welding process. In this case, one side edge of the triangular surface element is connected to the projection and another side of the surface element is connected to the side wall section of the heat shield element. Further details can be gathered from an exemplary embodiment shown in FIG. 4.

However, it is likewise also possible to design the extension in the form of a bar-shaped element which is connected to the side wall section of the heat shield element in the bar longitudinal extent and the end face of which is connected to that side of the respective projection which faces away from the clear intermediate space. In all cases of the design of the extension, it is necessary for the increased height of the extension relative to the side wall section of the heat shield element not to be selected to be greater than that of the respective projection itself. The projections advantageously project above the respectively provided extension, so that it is always ensured that the projections connected in one piece to the heat shield element are the decisive factor in determining the axial distance from the adjacent blade and are not affected by the subsequent extensions provided by the welding process.

In principle, it would be conceivable, by a corresponding mold design, for the at least one extension adjoining the respective projection in the circular circumferential direction to already be produced during the process for casting the heat shield element itself, which is a variant to which the scope of protection of claim 1 is intended to apply in the same way, but rework of already produced heat shield elements or of heat shield elements already in use permits, in the sense according to the solution, the modification of heat shield elements by a subsequent welding process without at the same time changing the design of casting patterns.

Thus, the method described in claim 9 for producing the locking and fixing device for a heat shield element which can be connected to a rotor unit of an axial-flow turbomachine according to the preamble of claim 9 makes possible the rework of an existing heat shield element in such a way that a build-up of material which extends in the circular circumferential direction and is connected to the projection and the side wall section is provided on at least one rib-like projection on its side facing away from the clear intermediate space, said build-up of material preferably being effected by a welding process. Further details in this respect can be gathered from the exemplary embodiments described with reference to the figures.

Shown in FIG. 1*a* in a perspective illustration is a heat shield element 4 which has root contours 12 of appropriate shape for fastening in the rotor unit 1. Arranged radially opposite the root contours 12 is a shroud band 5, which prevents the hot gases inside the hot duct from coming into direct contact with the rotor unit 1. The heat shield element 4 has an essentially axially oriented side wall section 8, from which rib-like projections 9, 10 rise. The two rib elements 9, 10 mutually enclose a clear intermediate space 13, into which a fastening or locking lug 11 (not shown) provided by the blade can be inserted axially. A further projection 14 of rib-like design is additionally provided, this projection 14 being arranged radially above the clear intermediate space 13.

To avoid incorrect fitting between heat shield element 4 and blade 2, 3 the embodiment shown in FIG. 1*a* provides extensions 15, 16 of bar-shaped design, which are each provided on those sides of the projections 9, 10 of rib-like design which in each case face away from the intermediate space. The extensions 15, 16 of bar-shaped design have a height which is raised above the side wall section 8 and is equal to or preferably less than that of the projections 9, 10 raised above the side wall section 8. The longitudinal extent, oriented in the circular circumferential direction u, of the respective extensions 15, 16 is dimensioned to be longer than the maximum possible maladjustment of a blade relative to a heat shield element already used on a rotor unit, so that the possibility of a fastening or locking lug arranged on the blade side coming to lie laterally next to the extensions 15, 16 adjoining the projections 9, 10 can be ruled out in any event.

Figure 1B:
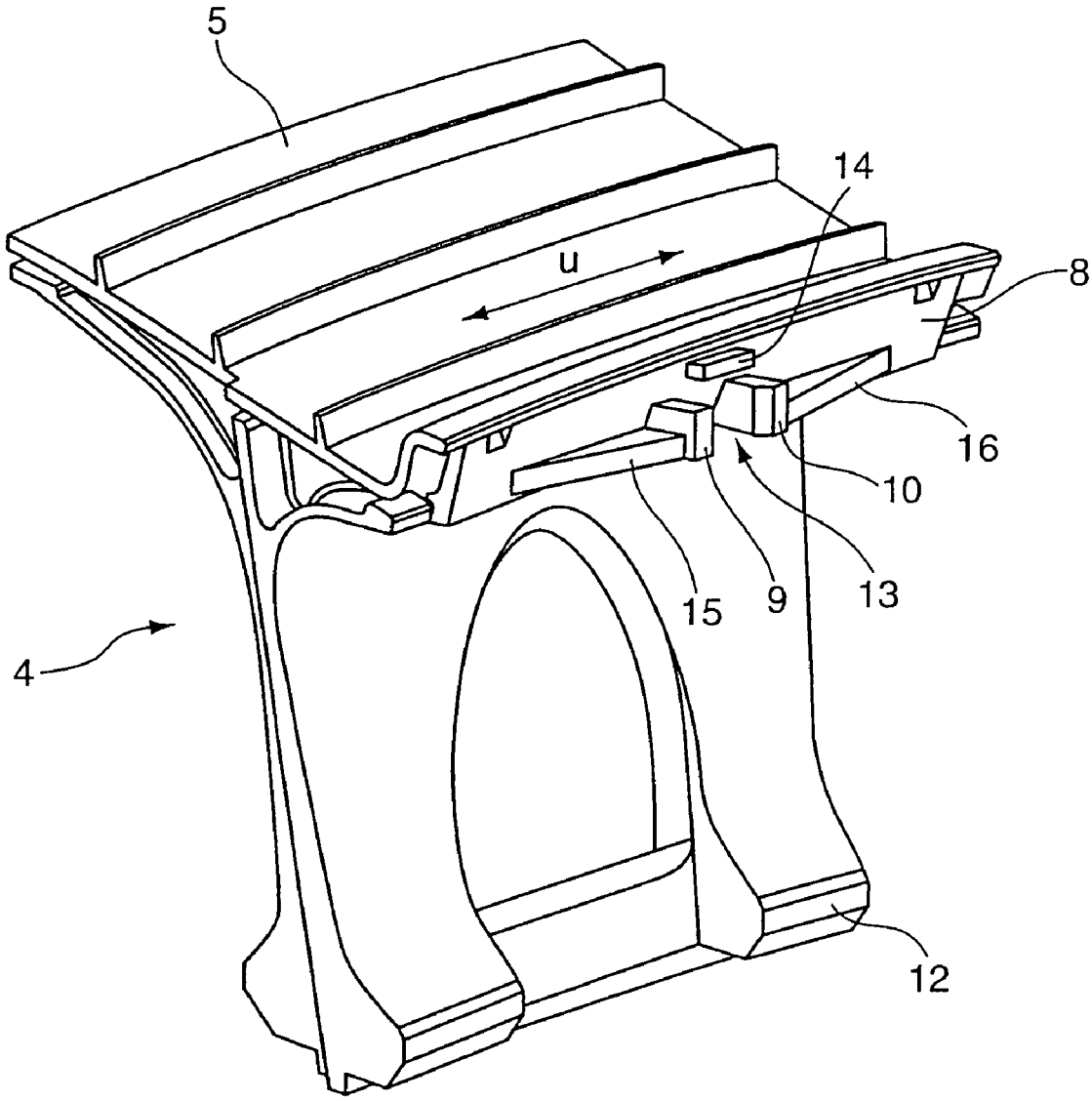

In the exemplary embodiment according to FIG. 1*b*, the extensions 15, 16 laterally adjoining the projections 9, 10 are designed as triangular surface elements, the one side edge of which is connected in each case to that side of the projection 9, 10 which faces away from the clear intermediate space and the other side edge of which is connected to the side wall section 8. The connection is preferably made via respective welded joints.

It is of course possible, in deviation from the exemplary embodiments shown in FIGS. 1*a* and 1*b*, to provide in each case only one projection 9 or 10 with a corresponding extension.

Figure 2:
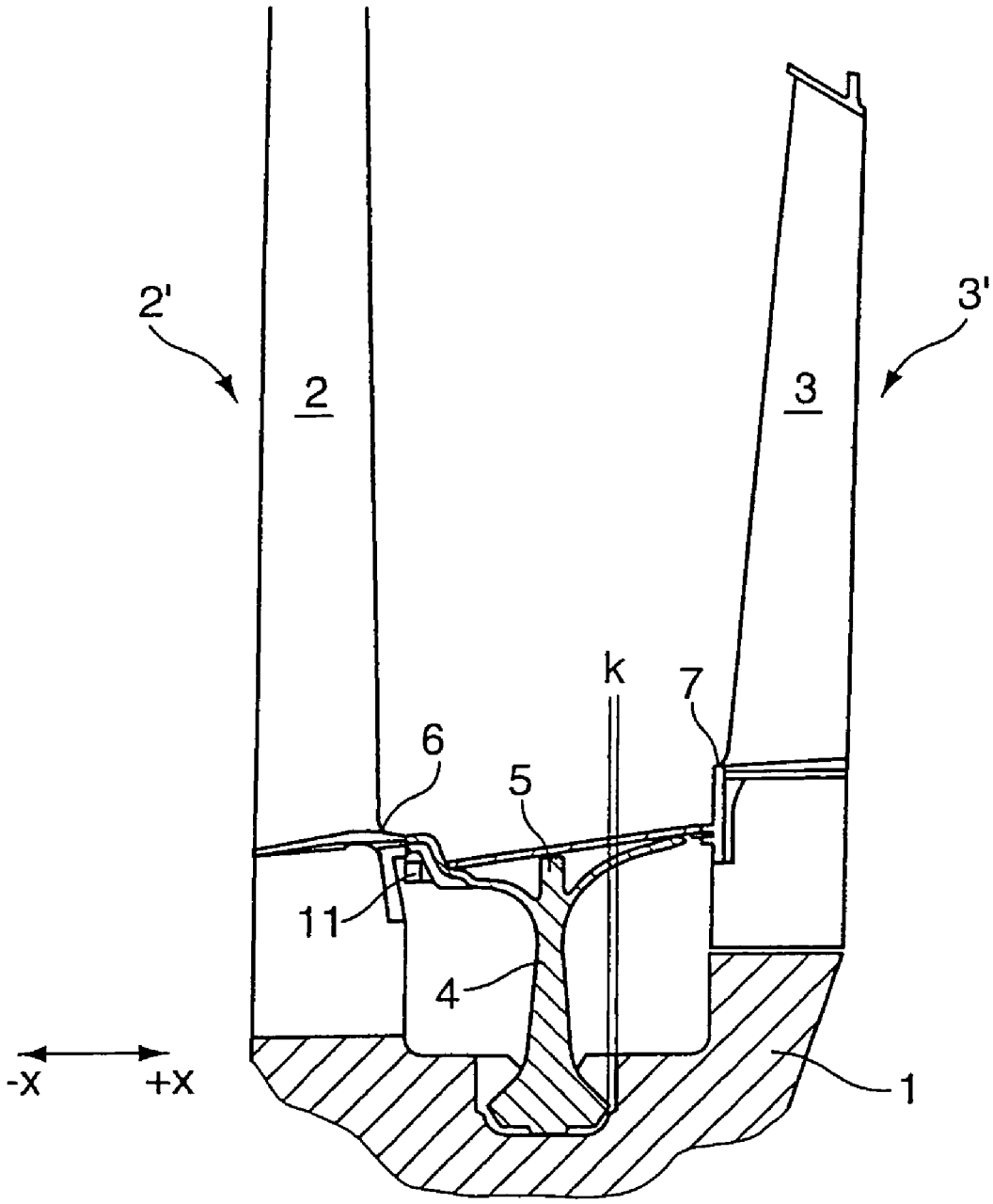
FIG. 2 shows a partial longitudinal section through a rotor arrangement having blades and a heat shield element arranged in between according to the prior art.
Figure 3:
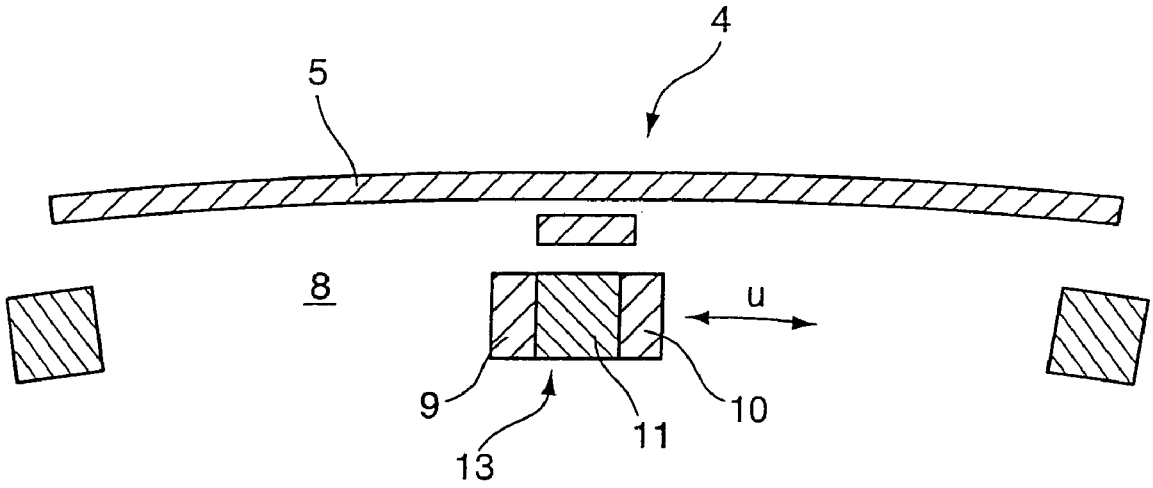
FIG. 3 shows a partial side view of a heat shield element having a shroud band and projections according to the prior art.

With regard to the description of FIGS. 2 and 3, reference is made to the introduction to the description, in which reference has already been made to the already known arrangements.

Figure 4:
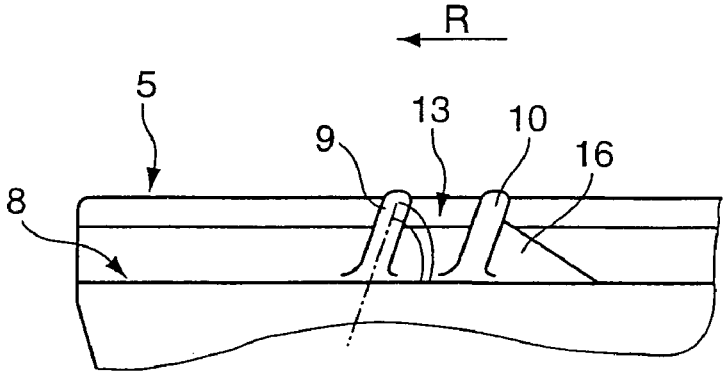
FIG. 4 shows a partial illustration in the radial direction of a heat shield element having projections of rib-like design.

FIG. 4 represents a radial partial view of a heat shield element 4 and shows the increased height of the projections 9, 10 of rib-like design above the side wall section 8. Both projections 9, 10 of rib-like design are inclined relative to the side wall section 8 and enclose with the side wall section 8 an angle $\alpha$ which is preferably 75° (see direction of rotation R of the rotor unit). For mechanical reinforcement, but in particular for protection against incorrect fitting, at least the rib-like projection 10 has additional reinforcement in the form of an extension 16 of triangular design. The extension 16 is located on that side of the projection 10 which faces away from the intermediate space 13 and is firmly welded to both the projection 10 and the side wall section 8.

In the simplest case, however, it is also conceivable, instead of a surface element, to fill the region directly adjoining a projection in the circumferential direction by means of welding material deposits in order to achieve specific material accumulation for the purposes of the mechanical reinforcement and the lateral widening of the projections.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

1 Rotor unit
2, 3 blade
2', 3' blade row
4 Heat shield element
5 Shroud band
6, 7 Shroud bands of the blades
8 Side wall section
9, 10 Projections of rib-like design
11 Fastening lug, locking lug
12 Root contour, fastening contour
13 Clear intermediate space
14 Further projection
15, 16 Extension

What is claimed is:

1. A locking and fixing device for a heat shield element which can be connected to a rotor unit of an axial-flow turbomachine and which can be arranged along a heat shield row axially directly next to at least one blade provided in a blade row, the locking and fixing device comprising:

at least two rib-like projections for axially facing the blade which are spaced apart in a circular circumferential direction, the rib-like projections being raised above a side wall section facing the blade to define an intermediate space which extends in the circular circumferential direction and into which a locking lug provided on the blade can be fitted; and an extension on at least one of the two rib-like projections, on a side facing away from the intermediate space, in the circular circumferential direction, the extension being connected to the at least one rib-like projection and the side wall section to rise above the side wall section at most up to a rib height of the at least one rib-like projection.

2. The device as claimed in claim 1, in combination with the heat shield element, wherein the rib-like projections are produced in one piece with the heat shield element by a casting process, and the extension is joined to the at least one rib-like projection and to the side wall section by a joint using joining technology.

3. The device as claimed in claim 2, wherein the at least one extension is joined to the heat shield element by a weld.

4. The device as claimed in claim 3, wherein the extension is made of the same material as the heat shield element.

5. The device as claimed in claim 1, wherein the extension is made of the same material as the heat shield element.

6. The device as claimed in claim 5, wherein the extension is in the form of a triangular surface element, one side edge of which is connected to that side of the projection which faces away from the intermediate space, and another side edge is connected to the side wall section of the heat shield element.

7. The device as claimed in claim 5, wherein the extension is in the form of a bar-shaped element, the extension being connected to the side wall section in the bar shared element's longitudinal extent, and at an end face, to that side of the projection which faces away from the clear intermediate space.

8. The device as claimed in claim 1, wherein the extension is in the form of a triangular surface element, one side edge of which is connected to that side of the projection which faces away from the intermediate space, and another side edge is connected to the side wall section of the heat shield element.

9. The device as claimed in claim 1, wherein the extension is in the form of a bar-shaped element, the extension being connected to the side wall section in the bar shared element's longitudinal extent, and at an end facet to that side of the projection which faces away from the intermediate space.

10. The device as claimed in claim 9, wherein the rib-like projections are arranged adjacently to one another and each have two boundary flanks oriented parallel to one another, the boundary flanks with the side wall section forming an angle $\alpha \neq 90°$.

11. The device as claimed in claim 9, wherein the rib-like projections are arranged adjacently to one another and each have two boundary flanks oriented parallel to one another, the boundary flanks with the side wall section forming an angle $\alpha \neq 75°$.

12. The device as claimed in claim 1, wherein the rib-like projections are arranged adjacently to one another and each have two boundary flanks oriented parallel to one another, the boundary flanks with the side wall section forming an angle $\alpha \neq 90°$.

13. The device as claimed in claim 12, wherein plural extensions adjoin the at least two rib-like projections to face away from the intermediate space and extend in opposition in the circular circumferential direction.

14. The device as claimed in claim 1, wherein plural extensions adjoin the at least two rib-like projections in each case in such a way as to face away from the intermediate space and extend in opposition in the circular circumferential direction.

15. The device as claimed in claim 1, wherein the rib-like projections are arranged adjacently to one another and each have two boundary flanks oriented parallel to one another, the boundary flanks with the side wall section forming an angle $\alpha \neq 75°$.

16. A method for producing a locking and fixing device for a heat shield element which can be connected to a rotor unit of an axial-flow turbomachine and which can be arranged along a heat shield row axially directly next to at least one blade provided in a blade row, the method comprising:

forming at least two rib-like projections for axially facing the blade which are spaced apart in the circular circumferential direction, the rib-like projections being raised above a side wall section facing the blade to define an intermediate space which extends in the circular circumferential direction and into which a locking lug provided on the blade can be fitted; and building-up material which extends in the circular circumferential direction and is connected to at least one of the two rib-like projections on a side facing away from the intermediate space and to the side wall section.

17. The method as claimed in claim 16, wherein the building-up of material is carried out by a welding process.

18. The method as claimed in claim 17, wherein the building-up of material is welded in the form of a planar or bar-shaped element to that side of the at least one rib-like projection which faces away from the intermediate space.

19. The method as claimed in claim 16, wherein the building-up of material is welded in the form of a planar or bar-shaped element to that side of the at least one rib-like projection which faces away from the intermediate space.

* * * * *